US010381023B2

(12) United States Patent
Otani et al.

(10) Patent No.: US 10,381,023 B2
(45) Date of Patent: Aug. 13, 2019

(54) SPEECH EVALUATION APPARATUS AND SPEECH EVALUATION METHOD

(71) Applicant: FUJITSU LIMITED, Kawasaki-shi, Kanagawa (JP)

(72) Inventors: Takeshi Otani, Kawasaki (JP); Taro Togawa, Kawasaki (JP); Sayuri Nakayama, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 0 days.

(21) Appl. No.: 15/703,249

(22) Filed: Sep. 13, 2017

(65) Prior Publication Data

US 2018/0090156 A1 Mar. 29, 2018

(30) Foreign Application Priority Data

Sep. 23, 2016 (JP) ..... 2016-186324

(51) Int. Cl.
*G10L 19/00* (2013.01)
*G10L 25/60* (2013.01)
(Continued)

(52) U.S. Cl.
CPC ..... *G10L 25/60* (2013.01); *G10L 21/0205* (2013.01); *G10L 25/06* (2013.01);
(Continued)

(58) Field of Classification Search
CPC ..... G10L 19/06; G10L 25/93; G10L 13/02; G10L 19/012; G10L 19/083; G10L 19/09;
(Continued)

(56) References Cited

U.S. PATENT DOCUMENTS 5,054,073 A * 10/1991 Yazu ..... G10L 19/0204 704/205
5,729,658 A * 3/1998 Hou ..... G10L 25/69 381/60

(Continued)

FOREIGN PATENT DOCUMENTS

JP 2002-91482 A 3/2002
JP 2007-4001 A 1/2007

(Continued)

OTHER PUBLICATIONS

Neuburg, "On Estimating Change of Pitch", Apr. 11, 1988, pp. 355-357; cited in Extended European Search Report dated Feb. 22, 2018.*

(Continued)

*Primary Examiner* — Vijay B Chawan
(74) *Attorney, Agent, or Firm* — Westerman, Hattori, Daniels & Adrian, LLP

(57) ABSTRACT

A speech evaluation apparatus includes a memory, and a processor coupled to the memory and configured to generate a first input spectrum obtained by frequency transforming a first signal that is a signal of a first period, generate a second input spectrum obtained by frequency transforming a second signal that is the signal of a second period earlier than the first period, generate a processed spectrum obtained by transforming frequency of the second input spectrum based on a change ratio set in advance, calculate a correlation value between the first input spectrum and the processed spectrum, and determine a change amount of pitch frequency from the first signal to the second signal based on the change ratio and the correlation value.

7 Claims, 8 Drawing Sheets

(51) Int. Cl.

| | |
|---|---|
| ***G10L 21/02*** | (2013.01) |
| ***G10L 25/06*** | (2013.01) |
| ***G10L 25/18*** | (2013.01) |
| ***G10L 25/90*** | (2013.01) |

(52) U.S. Cl.
CPC ..... *G10L 25/18* (2013.01); *G10L 25/90* (2013.01); *G10L 2025/906* (2013.01)

(58) Field of Classification Search
CPC ... G10L 19/107; G10L 19/125; G10L 19/135; G10L 19/18; G10L 21/0264; G10L 25/78; G10L 19/08; G10L 21/0208; G10L 25/90; G10L 13/04; G10L 15/20; G10L 19/02024; G10L 19/04; G10L 19/10
USPC ..... 704/205, 207, 208, 210, 215, 226, 233, 704/206, 212, 216, 219, 220, 224, 225, 704/227, 229, 244, 248
See application file for complete search history.

(56) References Cited

U.S. PATENT DOCUMENTS

| | | | | |
|---|---|---|---|---|
| 6,108,621 | A * | 8/2000 | Nishiguchi | G10L 19/08 704/207 |
| 6,526,378 | B1 * | 2/2003 | Tasaki | G10L 21/0208 704/224 |
| 8,190,428 | B2 * | 5/2012 | Yamaura | G10L 19/012 704/219 |
| 8,532,986 | B2 * | 9/2013 | Matsumoto | G10L 25/93 704/208 |
| 8,949,118 | B2 * | 2/2015 | Avargel | G10L 25/90 704/205 |
| 8,972,255 | B2 * | 3/2015 | Leman | G10L 15/20 704/210 |
| 2003/0182123 | A1 | 9/2003 | Mitsuyoshi | |
| 2005/0108004 | A1 * | 5/2005 | Otani | G10L 15/1807 704/205 |
| 2006/0053003 | A1 * | 3/2006 | Suzuki | G10L 25/78 704/216 |
| 2007/0118379 | A1 * | 5/2007 | Yamaura | G10L 19/012 704/267 |
| 2010/0004934 | A1 * | 1/2010 | Hirose | G10L 13/04 704/261 |
| 2013/0188799 | A1 * | 7/2013 | Otani | H04B 3/20 381/66 |

FOREIGN PATENT DOCUMENTS

| | | | |
|---|---|---|---|
| JP | 2007-286377 | A | 11/2007 |
| JP | 2008-15212 | A | 1/2008 |
| JP | 2013-157666 | A | 8/2013 |

OTHER PUBLICATIONS

Backstrom, et al., "Pitch Variation Estimation", Proceedings Interspeech 2009 Conference, Sep. 6, 2009, pp. 2595-2598, Jun. 9, 2009.*

Neuburg, E.P., "On Estimating Change of Pitch", Apr. 11, 1988, pp. 355-357; cited in Extended European Search Report dated Feb. 22, 2018.

Morise, "Fundamental Frequency Estimation (from viewpoint relating to research on singing voice)," Knowledge Base, the Institute of Electronics, Information and Communication Engineers, pp. 1-5, 2010, cited in the specification (17 pages, including partial translation).

Neuburg, E.P., "On Estimating Rate of Change of Pitch", Apr. 11, 1988, pp. 335-337; cited in Extended European Search Report dated Feb. 22, 2018.

Backstrom, T. et al, "Pitch Variation Estimation", Proceedings Interspeech 2009 Conference, Sep. 6, 2009, pp. 2595-2598; cited in Extended European Search Report dated Feb. 22, 2018.

Extended European Search Report dated Feb. 22, 2018, issued in counterpart European Application No. 17191059.9. (6 pages).

* cited by examiner

SPEECH EVALUATION APPARATUS AND SPEECH EVALUATION METHOD

CROSS-REFERENCE TO RELATED APPLICATION

This application is based upon and claims the benefit of priority of the prior Japanese Patent Application No. 2016-186324, filed on Sep. 23, 2016, the entire contents of which are incorporated herein by reference.

FIELD

The embodiments discussed herein are related to speech evaluation apparatus and speech evaluation method.

BACKGROUND

In the cases in which the contents of speech greatly affect the company image, such as operation services by a telephone and over-the-counter services at a bank or the like, quantitative speech evaluation is important for improvement in the quality of the contents of speech.

As one of indexes for quantitatively carrying out speech evaluation, the inflection of speech voice exists. The magnitude of the inflection of speech voice may be quantified as time change of the tone height of the voice.

As a technique for extracting the time change of the tone height of voice, a pitch estimation technique exists. The pitch estimation technique is a technique for detecting a peak of a voice spectrum in the case in which a voice waveform is transformed to the frequency domain based on the correlation between one section and another section in the voice waveform. As the pitch estimation technique, Masanori Morise, "Knowledge Base," *the Institute of Electronics, Information and Communication Engineers*, pp. 1-5, 2010, has been disclosed, for example.

CITATION LIST

Patent Documents

[Patent Document 1] Japanese Laid-open Patent Publication No. 2002-91482

[Patent Document 2] Japanese Laid-open Patent Publication No. 2013-157666

[Patent Document 3] Japanese Laid-open Patent Publication No. 2007-286377

[Patent Document 4] Japanese Laid-open Patent Publication No. 2008-15212

[Patent Document 5] Japanese Laid-open Patent Publication No. 2007-4001

SUMMARY

According to an aspect of the embodiments, a speech evaluation apparatus includes a memory, and a processor coupled to the memory and configured to generate a first input spectrum obtained by frequency transforming a first signal that is a signal of a first period, generate a second input spectrum obtained by frequency transforming a second signal that is the signal of a second period earlier than the first period, generate a processed spectrum obtained by transforming frequency of the second input spectrum based on a change ratio set in advance, calculate a correlation value between the first input spectrum and the processed spectrum, and determine a change amount of pitch frequency from the first signal to the second signal based on the change ratio and the correlation value.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

Distortion is often generated in a voice waveform received by a microphone due to the influence of the voice propagation path from the talker to the microphone, the influence of the frequency gain of the microphone, and so forth. If distortion is generated in the voice waveform, when the correlation of each section is compared by a pitch estimation technique, the correlation at not the fundamental pitch frequency but a frequency that is an integral multiple of the fundamental pitch frequency is high in some cases. The frequency of the integral multiple with the high correlation is erroneously determined to be the fundamental pitch frequency and thus a voice having a low inflection actually is erroneously recognized as a voice having a high inflection.

The disclosed techniques intend to accurately determine the change amount of the fundamental pitch frequency even if distortion is generated in the voice waveform.

(First Embodiment)

Figure 1:
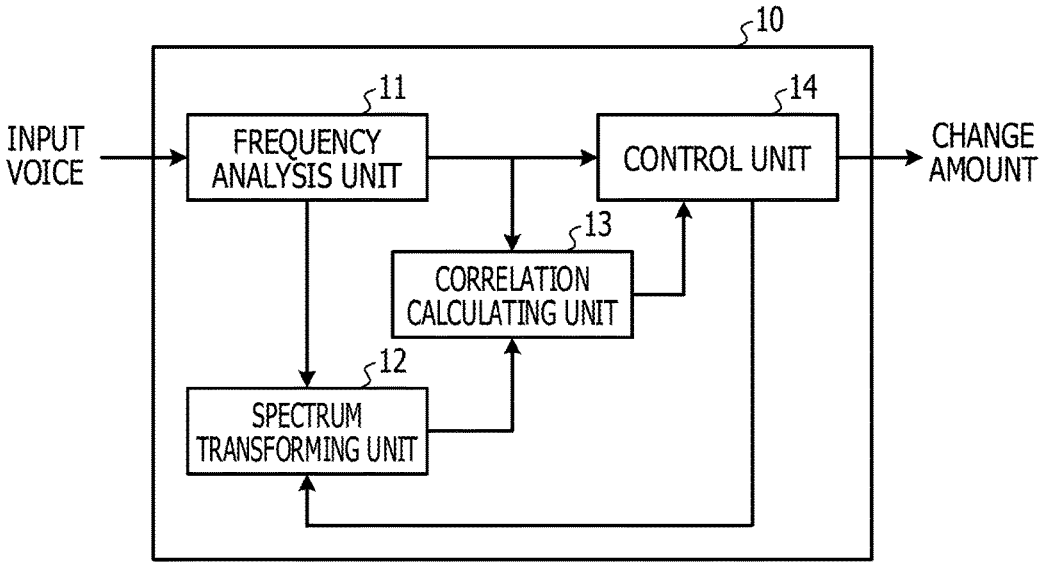
FIG. 1 is a functional block diagram illustrating one example of use form of speech evaluation apparatus in a first embodiment.

FIG. 1 is a functional block diagram illustrating one example of use form of speech evaluation apparatus in a first embodiment. In the functional block diagram of FIG. 1, speech evaluation apparatus 10 includes a frequency analysis unit 11, a spectrum transforming unit 12, a correlation calculating unit 13, and a control unit 14. The speech evaluation apparatus 10 analyses an input voice and outputs the analysis result as the change amount.

The frequency analysis unit 11 carries out frequency analysis of the input voice and calculates an input spectrum. The spectrum transforming unit 12 transforms the frequency of the calculated input spectrum based on a provisional change amount set in advance and calculates a processed spectrum. The provisional change amount is set by the control unit 14 to be described later. The input voice is segmented into certain sections called frames and the speech evaluation is carried out about each frame. The spectrum transforming unit 12 outputs a processed spectrum corresponding to a frame previous to the frame corresponding to the input spectrum output from the frequency analysis unit 11. The spectrum transforming unit 12 may include a storing unit for holding the input spectrum before transforming for a certain period.

The correlation calculating unit 13 calculates the correlation between the input spectrum output from the frequency analysis unit 11 and the processed spectrum output from the spectrum transforming unit 12. The correlation calculating unit 13 outputs the calculated correlation value to the control unit 14. The control unit 14 determines the change amount based on the provisional change amount and the correlation value. The control unit 14 outputs the provisional change amount corrected based on the calculated correlation value and the input spectrum to the spectrum transforming unit 12. Furthermore, the control unit 14 includes a storing unit that holds the correlation value received from the correlation calculating unit 13 for a certain period.

The spectrum transforming unit 12 calculates the processed spectrum based on the provisional change amount after the correction with respect to the input spectrum held in the storing unit. The correlation calculating unit 13 calculates the correlation value between the input spectrum and the processed spectrum after the correction and outputs the correlation value to the control unit 14. The control unit 14 stores the calculated correlation value and corrects the provisional change amount to output the corrected provisional change amount to the spectrum transforming unit 12.

The control unit 14 refers to plural correlation values calculated with correction of the provisional change amount and outputs the provisional change amount corresponding to the case in which the correlation value is largest as the change amount.

As described above, the speech evaluation apparatus 10 may determine the change amount based on the correlation value between the input spectrum and the processed spectrum with correction of the provisional change amount. Due to this, according to the present embodiment, it becomes possible to directly obtain the change amount of the fundamental pitch without obtaining the fundamental pitch frequency itself of voice. Therefore, according to the present embodiment, it becomes possible to accurately obtain the change amount of the fundamental pitch even if distortion is generated in the voice waveform.

(Second Embodiment)

Figure 2:
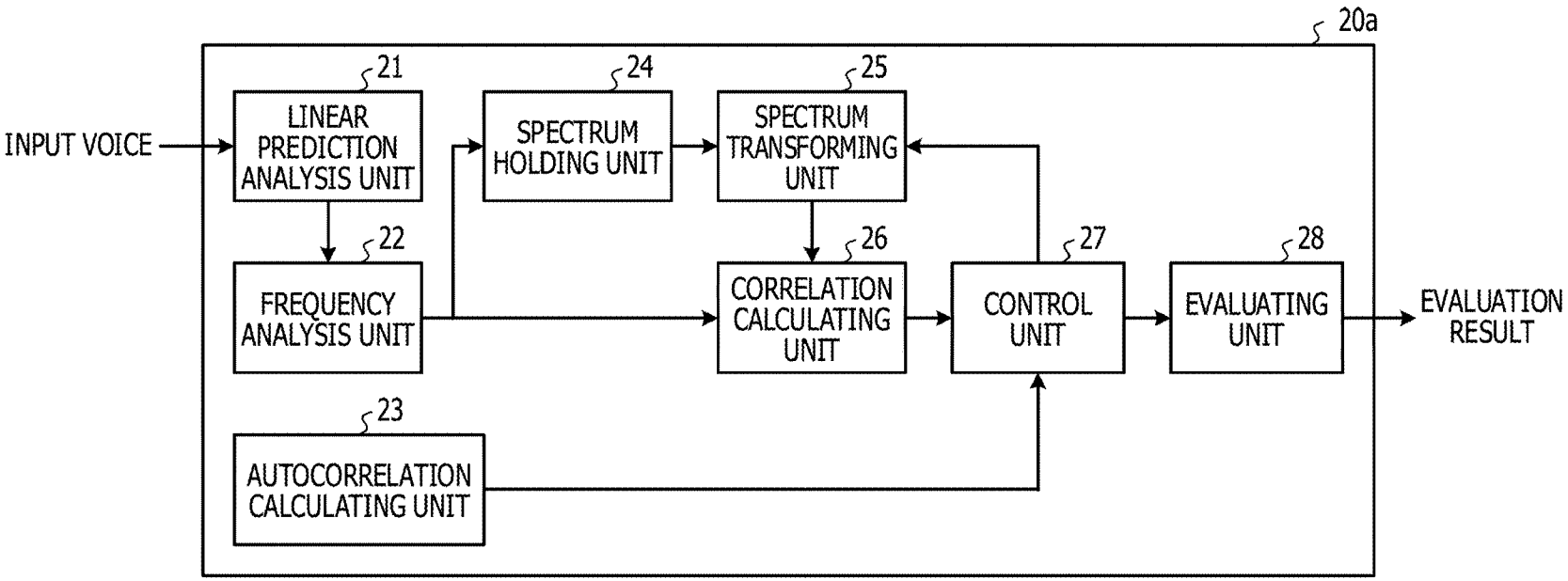
FIG. 2 is a functional block diagram illustrating one example of use form of speech evaluation apparatus in a second embodiment.

FIG. 2 is a functional block diagram illustrating one example of use form of speech evaluation apparatus in a second embodiment. In the functional block diagram of FIG. 2, speech evaluation apparatus 20*a* includes a linear prediction analysis unit 21, a frequency analysis unit 22, an autocorrelation calculating unit 23, a spectrum holding unit 24, a spectrum transforming unit 25, a correlation calculating unit 26, a control unit 27, and an evaluating unit 28. The speech evaluation apparatus 20*a* may be implemented by using a programmable logic device such as a field-programmable gate array (FPGA) or may be implemented through execution of a speech evaluation program for processing the respective functions of the speech evaluation apparatus 20*a* by a central processing unit (CPU).

The autocorrelation calculating unit 23 calculates the autocorrelation of an input signal and outputs an enable signal for causing the control unit 27 to execute estimation processing of the change amount in the frame about which the autocorrelation is calculated if the autocorrelation is equal to or larger than a threshold set in advance. By inputting the enable signal output from the autocorrelation calculating unit 23 to the linear prediction analysis unit 21, the speech evaluation apparatus 20*a* may execute the speech evaluation processing only when the enable signal is output.

(Expression 1) is an expression for calculating autocorrelation Ar of the input signal. In (Expression 1), xn(t) denotes the input signal, n denotes the frame number, t denotes the time, N denotes the order of the autocorrelation, i denotes a counter, and M denotes the search range of the autocorrelation. The autocorrelation calculating unit 23 calculates the autocorrelation Ar of each frame based on (Expression 1) and outputs the enable signal if Ar is equal to or larger than the threshold set in advance.

$$Ar = \max_{m-1}^{M}\left(\frac{\sum_{i-1}^{N} x_n(t)\cdot x_n(t-i)}{\sum_{i=1}^{N}(x_n(t))^2}\right) \quad \text{(Expression 1)}$$

The linear prediction analysis unit 21 calculates a residual signal by carrying out linear prediction analysis about the input voice to obtain a prediction coefficient. The linear prediction analysis unit 21 outputs the calculated residual signal. (Expression 2) is a calculation expression of a residual signal x'n(t). In (Expression 2), $\alpha i$ denotes the prediction coefficient. The linear prediction analysis unit 21 calculates the prediction coefficient $\alpha i$ by the linear prediction analysis and outputs the residual signal x'n(t) calculated based on (Expression 2).

$$x'_n(t) = x_n(t) + \sum_{i=1}^{N} \alpha_i \cdot x_n(t-i) \quad \text{(Expression 2)}$$

The frequency analysis unit 22 executes frequency transform processing such as a fast Fourier transform (FFT) for the residual signal x'n(t) received from the linear prediction analysis unit 21 and obtains an input spectrum Xn(f). The frequency analysis unit 22 outputs the calculated input spectrum Xn(f).

The spectrum holding unit 24 temporarily holds and outputs the input spectrum Xn−1(f) of the previous frame, received from the frequency analysis unit 22. The spectrum transforming unit 25 executes spectrum transform processing of the input spectrum Xn−1(f) received from the spectrum holding unit 24. When a provisional change amount "ratio" set for the spectrum transform is represented by (Expression 3), the spectrum transforming unit 25 calculates a processed spectrum based on the provisional change amount by (Expression 4). The provisional change amount is received from the control unit 27. The spectrum transforming unit 25 outputs the processed spectrum calculated based on the provisional change amount. In (Expression 3), j is a loop counter. With increment of the value of j, the calculation of the processed spectrum and the following correlation coefficient calculation processing are repeated. Furthermore, the purpose of using a root of 2 in (Expression 3) is to detect the change amount of about one octave of the input voice. Here, the provisional change amount represents the frequency ratio between the spectrum before transforming and the spectrum after transforming and therefore may be expressed as a provisional change ratio.

$$\text{ratio} = 0.5 \times \left(\sqrt[12]{2}\right)^{j} \quad \text{(Expression 3)}$$

$$\tilde{X}(f \times \text{ratio}) = X_{n-1}(f) \quad \text{(Expression 4)}$$

The correlation calculating unit 26 calculates a correlation coefficient R between the input spectrum of the n-th frame received from the frequency analysis unit 22 and the processed spectrum obtained by transforming the input spectrum of the n−1-th frame based on the provisional change amount based on (Expression 5). In (Expression 5), a variable k is each frequency component in the input spectrum and the processed spectrum.

$$R = \frac{\sum_{k} \left(\tilde{X}(k) \cdot X_n(k)\right)}{\sum_{k} \left(\tilde{X}(k)\right)^2} \quad \text{(Expression 5)}$$

The control unit 27 stores the correlation coefficient R received from the correlation calculating unit 26. The control unit 27 compares the received correlation coefficient R and the stored correlation coefficient R. If the received correlation coefficient R is larger, the control unit 27 overwrites the already-stored correlation coefficient R with the received correlation coefficient R in question and updates the provisional change amount to output the updated provisional change amount to the spectrum transforming unit 25. The spectrum transforming unit 25 calculates a processed spectrum based on the received provisional change amount after the update. The correlation calculating unit 26 calculates the correlation coefficient R between the newly-calculated processed spectrum and the input spectrum and outputs the correlation coefficient R to the control unit 27. If the provisional change amount "ratio" becomes larger than 2, the control unit 27 ends the above-described correlation coefficient calculation processing and outputs the stored correlation coefficient R and the provisional change amount corresponding to the stored correlation coefficient R as a settled change amount. It is to be noted that the control unit 27 sets each of the initial values of the stored correlation coefficient R and the provisional change amount to 0.

The evaluating unit 28 quantitatively evaluates the speech impression based on the settled change amount settled by the control unit 27. The evaluating unit 28 receives the settled change amounts of n frames and calculates an average An of the settled change amount based on (Expression 6).

$$A_n = \frac{1}{M} \cdot \sum_{t=0}^{M-1} \hat{ratio}_{n-1} \quad \text{(Expression 6)}$$

Thresholds TH1 and TH2 for evaluating the speech impression are set in the evaluating unit 28 in advance. By using the average of the settled change amount calculated by (Expression 6) and the thresholds, the evaluating unit 28 evaluates the speech impression based on (Expression 7). In (Expression 7), "good," "bad," and "mid" are defined as 1, −1, and 0, respectively, for example. The evaluating unit 28 outputs the evaluation result based on (Expression 7) to the outside of the speech evaluation apparatus 20*a*.

$$IM_n = \begin{cases} \text{"good"} & \text{if}(A > TH_1) \\ \text{"bad"} & \text{if}(A < TH_2) \\ \text{"}mid\text{"} & \text{else} \end{cases} \quad \text{(Expression 7)}$$

As described above, the speech evaluation apparatus 20*a* may accurately determine the change amount of the fundamental pitch frequency with high precision by calculating the correlation coefficient even when distortion is generated in the voice waveform with respect to the input voice. Furthermore, the speech evaluation apparatus 20*a* may output the more correct speech evaluation result based on the determination result of the change amount with the high precision.

Figure 3:
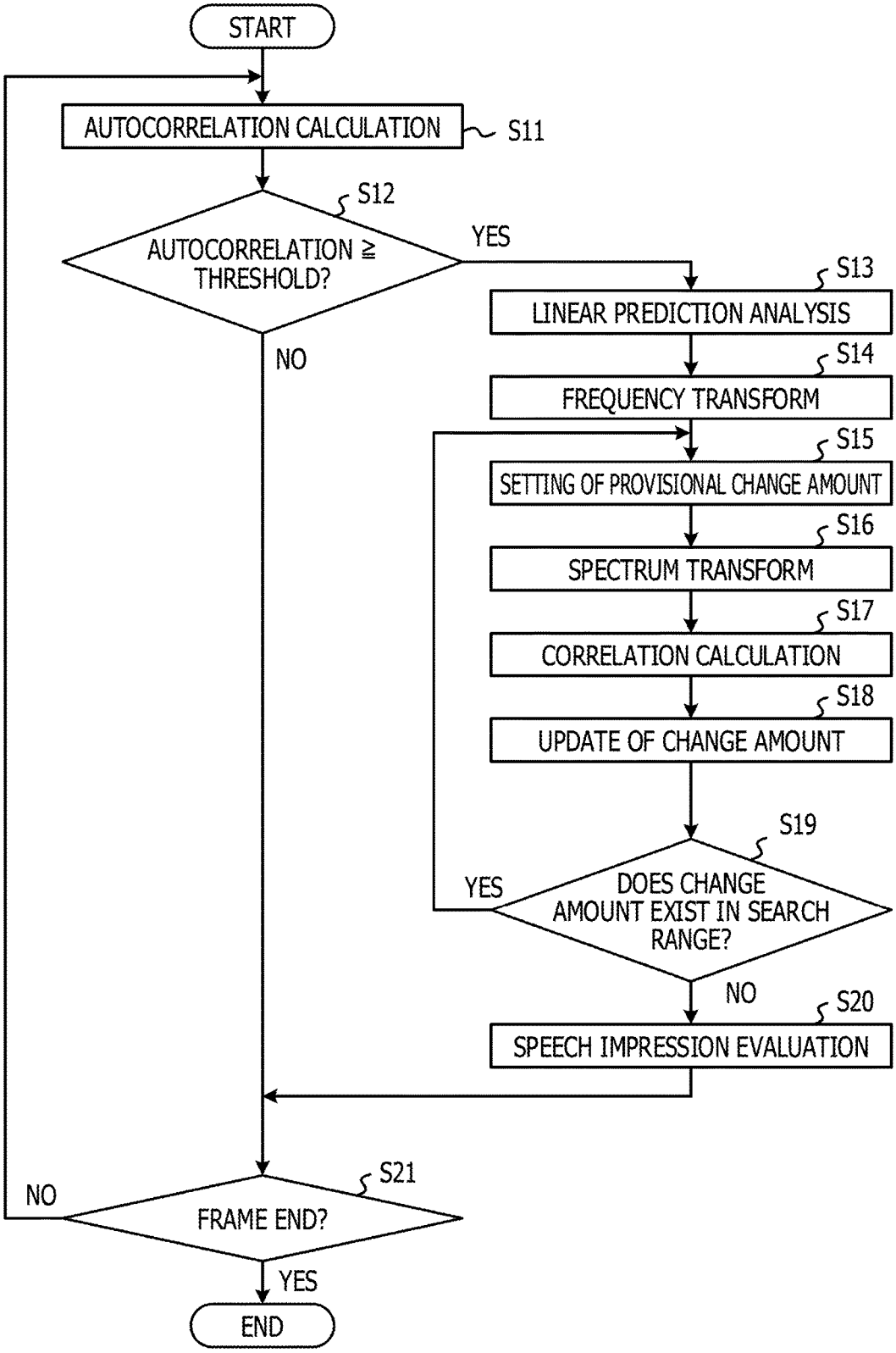
FIG. 3 is a speech evaluation processing flow of speech evaluation apparatus.

FIG. 3 is a speech evaluation processing flow of speech evaluation apparatus. A speech evaluation program for implementing the speech evaluation processing flow of FIG. 3 is, for example, stored in a storing device of a personal computer (PC) and a CPU implemented in the PC may read out the speech evaluation program from the storing device and execute the speech evaluation program.

The speech evaluation apparatus 20*a* calculates the autocorrelation of an input signal (step S11). If the calculated autocorrelation is equal to or larger than the threshold set in advance (step S12: YES), the speech evaluation apparatus 20*a* carries out the processing flow of a step S13 and the subsequent steps. On the other hand, if the calculated autocorrelation is smaller than the threshold set in advance (step S12: NO), the speech evaluation apparatus 20*a* executes frame end determination processing of a step S21.

The speech evaluation apparatus 20*a* carries out linear prediction analysis for the input signal (step S13). The speech evaluation apparatus 20*a* carries out a frequency transform of the input signal by a Fourier transform or the like to obtain an input spectrum (step S14).

The speech evaluation apparatus 20*a* sets a provisional change amount for searching for the change amount (step S15). The speech evaluation apparatus 20*a* carries out a spectrum transform of the input spectrum before change based on the set provisional change amount to calculate a processed spectrum (step S16). The speech evaluation apparatus 20*a* calculates the correlation between an input spectrum based on an input signal after change and the processed spectrum (step S17). The speech evaluation apparatus 20*a* updates the set provisional change amount (step S18). If the updated provisional change amount exists in a search range set in advance (step S19: YES), the speech evaluation apparatus 20*a* repeats the processing of the step S15 and the subsequent steps. On the other hand, if the updated provisional change amount does not exist in the search range (step S19: NO), the speech evaluation apparatus 20*a* carries out speech impression evaluation based on the searched change amount (step S20). If the autocorrelation calculation has not ended regarding all frames of the input voice (step S21: NO), the speech evaluation apparatus 20*a* executes the autocorrelation calculation processing of the step S11. On the other hand, if the autocorrelation calculation has ended regarding all frames (step S21: YES), the speech evaluation apparatus 20*a* ends the arithmetic processing.

As described above, if the autocorrelation is equal to or larger than a certain value, the speech evaluation apparatus 20*a* calculates the correlation value between the input spectrum and the processed spectrum with update of the provisional change amount and thereby may accurately calculate the change amount of the fundamental pitch frequency.

Furthermore, the speech evaluation apparatus 20*a* may output the speech evaluation result in real time by carrying out speech impression evaluation for each frame.

Figure 4:
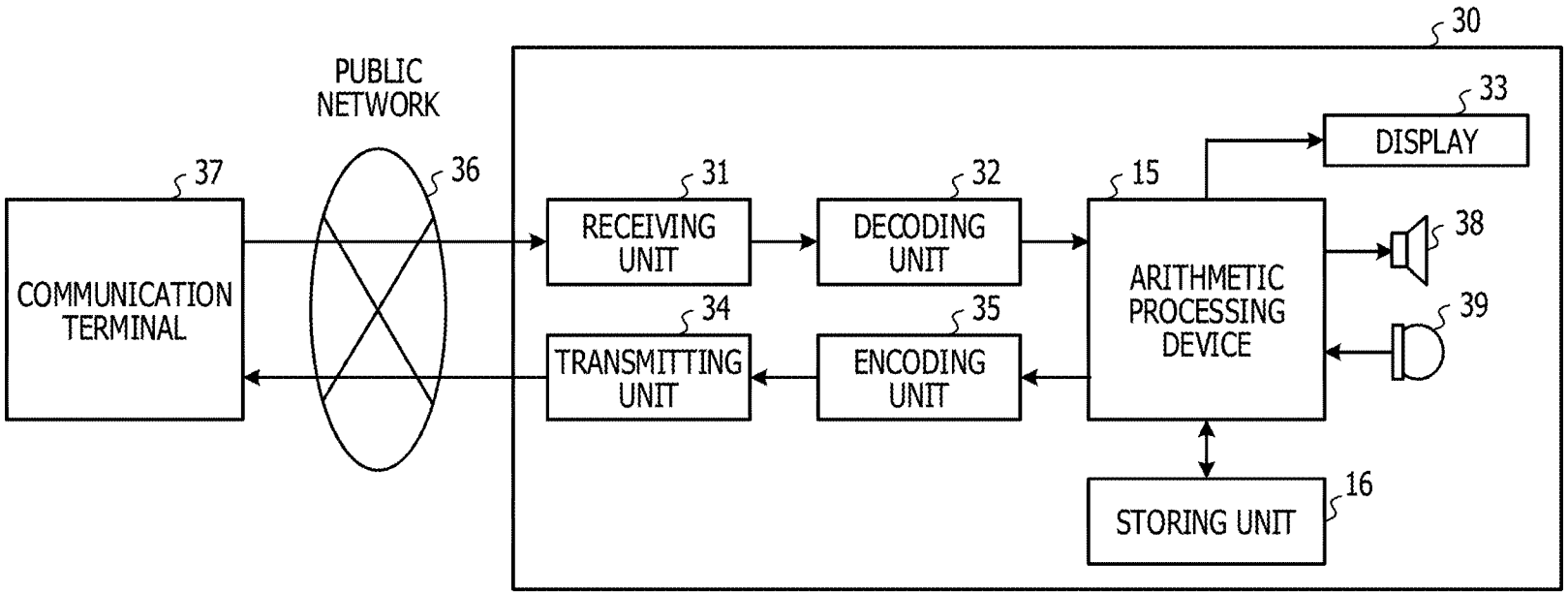
FIG. 4 is an implementation example of speech evaluation apparatus.

FIG. 4 is an implementation example of speech evaluation apparatus. In FIG. 4, the speech evaluation apparatus 20*a* is implemented in a communication terminal 30. The communication terminal 30 carries out voice communications with another communication terminal 37 through a public network 36.

The communication terminal 30 includes a receiving unit 31, a transmitting unit 34, a decoding unit 32, an encoding unit 35, an arithmetic processing device 15, a storing unit 16, a display 33, a speaker 38, and a microphone 39.

The receiving unit 31 receives a signal transmitted from the other communication terminal 37 and outputs a digital signal. The decoding unit 32 decodes the digital signal output from the receiving unit 31 and outputs a voice signal. The display 33 displays information on a screen based on a signal received from the arithmetic processing device 15. The speaker 38 amplifies and outputs the voice signal received from the arithmetic processing device 15. The microphone 39 converts speech voice to an electrical signal and outputs the electrical signal to the arithmetic processing device 15.

The arithmetic processing device 15 reads out a program that is stored in the storing unit 16 and is for executing speech evaluation processing, and implements functions as speech evaluation apparatus. The arithmetic processing device 15 executes the speech evaluation processing for the voice signal output from the decoding unit 32. The arithmetic processing device 15 transmits the speech evaluation result to the display 33. The arithmetic processing device 15 outputs the voice signal received from the decoding unit 32 to the speaker 38. The arithmetic processing device 15 outputs the voice signal received from the microphone 39 to the encoding unit 35. The arithmetic processing device 15 may execute the speech evaluation processing for the voice signal received from the microphone 39. The arithmetic processing device 15 may record the speech evaluation result in the storing unit 16.

The encoding unit 35 encodes the voice signal received from the arithmetic processing device 15 and outputs the encoded voice signal. The transmitting unit 34 transmits the encoded voice signal received from the encoding unit 35 to the communication terminal 37.

As described above, by implementing the speech evaluation processing, the communication terminal 30 may carry out speech evaluation about the voice signal received from another communication terminal and the voice signal obtained by speech to the communication terminal 30 itself.

(Third Embodiment)

Figure 5:
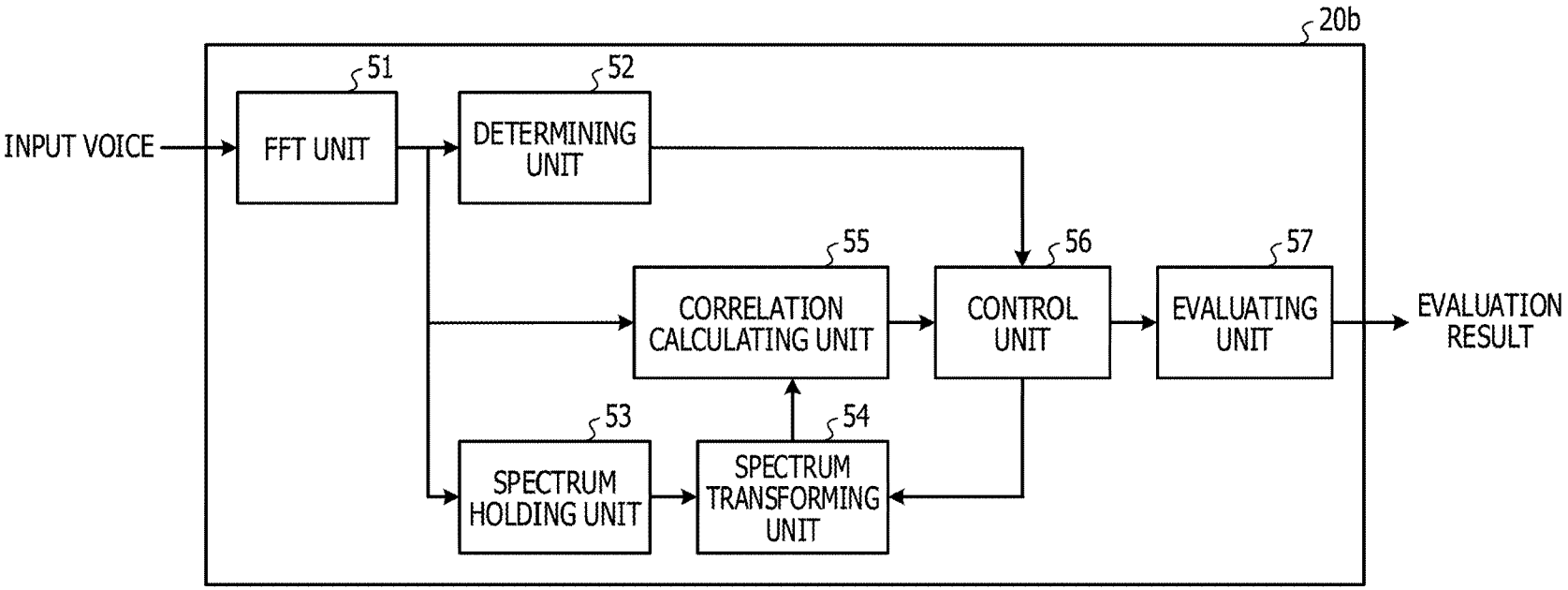
FIG. 5 is a functional block diagram illustrating one example of use form of speech evaluation apparatus in a third embodiment.

FIG. 5 is a functional block diagram illustrating one example of use form of speech evaluation apparatus in a third embodiment. In the functional block diagram of FIG. 5, speech evaluation apparatus 20*b* includes an FFT unit 51, a determining unit 52, a spectrum holding unit 53, a spectrum transforming unit 54, a correlation calculating unit 55, a control unit 56, and an evaluating unit 57. The speech evaluation apparatus 20*b* may be implemented by using a programmable logic device such as an FPGA or may be implemented through execution of a speech evaluation program for processing the respective functions of the speech evaluation apparatus 20*b* by a CPU.

The FFT unit 51 executes frequency transform processing such as an FFT for an input voice xn(t) to obtain a voice spectrum Xn(f). The determining unit 52 calculates a power spectrum Pn(f) with respect to the voice spectrum Xn(f) based on (Expression 8).

$$P_n(f)=10\log_{10}|X_n(f)|^2 \quad \text{(Expression 8)}$$

Moreover, by using the calculated power spectrum Pn(f), the determining unit 52 calculates a degree Dn of concavity and convexity of the power spectrum based on (Expression 9). It is to be noted that, in (Expression 9), N is a value obtained by dividing the number of FFT points by 2. From (Expression 9), the value of the degree Dn of concavity and convexity becomes a larger value when the difference between the values P(i) and P(i−1) of the power spectra adjacent on each frequency basis is larger.

$$D_n = \sum_{i=1}^{N-1} |P_n(i) - P_n(i-1)| \quad \text{(Expression 9)}$$

The determining unit 52 has a threshold set in advance. The determining unit 52 compares the magnitude between the calculated degree Dn of concavity and convexity and the threshold and outputs an enable signal for causing the control unit 56 to execute estimation processing of the change amount in the frame about which the voice spectrum is calculated if the degree Dn of concavity and convexity is higher than the threshold. By inputting the enable signal output from the determining unit 52 to the correlation calculating unit 55 and the spectrum holding unit 53, the speech evaluation apparatus 20*b* may carry out calculation for the speech evaluation processing only when the enable signal is output.

The spectrum holding unit 53 holds the voice spectrum calculated by the FFT unit 51 and outputs the held voice spectrum. The spectrum transforming unit 54 transforms the voice spectrum received from the spectrum holding unit 53 based on a provisional change amount received from the control unit 56 and outputs a processed spectrum. The transform from the voice spectrum to the processed spectrum is carried out by using (Expression 4) in the second embodiment. Furthermore, the provisional change amount is also calculated by using (Expression 3) similarly to the second embodiment.

The correlation calculating unit 55 calculates a correlation coefficient R between the voice spectrum output from the FFT unit 51 and the processed spectrum output from the spectrum transforming unit 54. The correlation calculating unit 55 calculates the correlation coefficient R by using (Expression 5) in the second embodiment.

The control unit 56 stores the correlation coefficient R received from the correlation calculating unit 55. The control unit 56 compares the received correlation coefficient R and the stored correlation coefficient R. If the received correlation coefficient R is larger, the control unit 56 overwrites the already-stored correlation coefficient R with the received correlation coefficient R in question and updates the provisional change amount to output the updated provisional change amount to the spectrum transforming unit 54. The spectrum transforming unit 54 calculates a processed spectrum based on the received provisional change amount after the update. The correlation calculating unit 55 calculates the correlation coefficient R between the newly-calculated processed spectrum and the input spectrum and outputs the correlation coefficient R to the control unit 56. If the provisional change amount "ratio" becomes larger than 2, the control unit 56 ends the above-described correlation coefficient calculation processing and outputs the stored correlation coefficient R and the provisional change amount corresponding to the stored correlation coefficient R as a settled change amount. It is to be noted that the control unit 56 sets each of the initial values of the stored correlation coefficient R and the provisional change amount to 0. The calculation and update of the provisional change amount Yn are carried out based on (Expression 10).

$$Y_n = \begin{cases} \log_2(\text{ratio}) & \text{if}(R > \hat{R}) \\ Y_n & \text{else} \end{cases} \quad \text{(Expression 10)}$$

The evaluating unit 57 quantitatively evaluates the speech impression based on the settled change amount settled by the control unit 56. The evaluating unit 57 receives the settled change amounts of n frames and calculates a time average S of the absolute value of the settled change amount based on (Expression 11). The evaluating unit 57 calculates a speech impression IM based on calculated S and (Expression 12). The evaluating unit 57 includes a storing unit that may record the settled change amounts of plural frames, for example.

$$S = \frac{1}{J} \cdot \sum_{l=1}^{J} |Y_n| \quad \text{(Expression 11)}$$

$$IM = \begin{cases} \text{"good"} & \text{if}(S > TH_1) \\ \text{"bad"} & \text{if}(S < TH_2) \\ \text{"}mid\text{"} & \text{else} \end{cases} \quad \text{(Expression 12)}$$

As described above, the speech evaluation apparatus 20*b* may accurately determine the change amount of the fundamental pitch frequency with high precision by calculating the correlation coefficient even when distortion is generated in the voice waveform with respect to the input voice. Furthermore, the speech evaluation apparatus 20*b* may output the more correct speech evaluation result based on the determination result of the change amount with the high precision.

Figure 6:
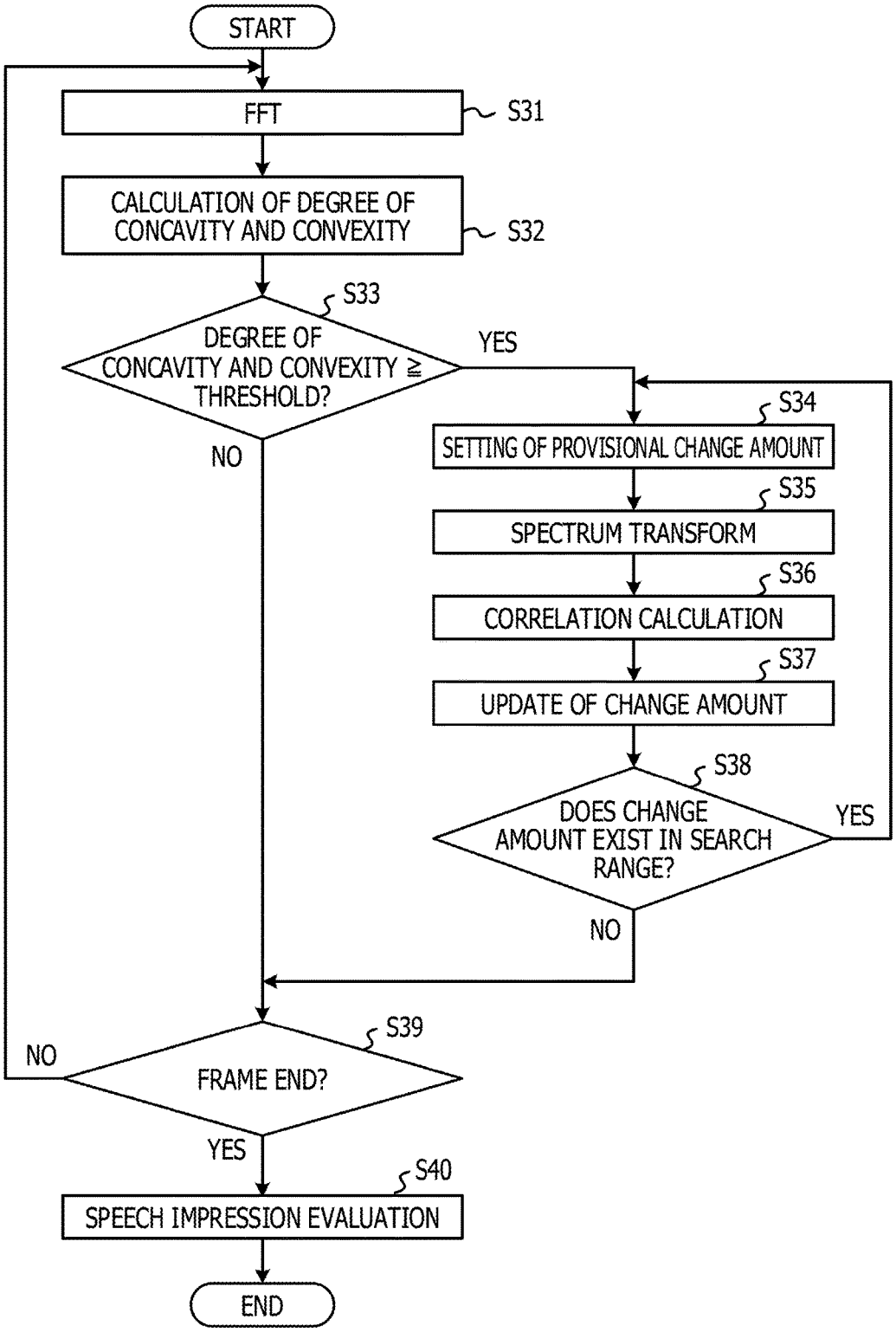
FIG. 6 is a speech evaluation processing flow of speech evaluation apparatus.

FIG. 6 is a speech evaluation processing flow of speech evaluation apparatus. A speech evaluation program for implementing the speech evaluation processing flow of FIG. 6 is, for example, stored in a storing device of a PC and a CPU implemented in the PC may read out the speech evaluation program from the storing device and execute the speech evaluation program.

The speech evaluation apparatus 20*b* executes frequency transform processing such as an FFT for an input signal to calculate an input spectrum (step S31). The speech evaluation apparatus 20*b* calculates a power spectrum based on the calculated input spectrum and calculates a degree of concavity and convexity of the calculated power spectrum (step S32). If the calculated degree of concavity and convexity is equal to or higher than the threshold set in advance (step S33: YES), the speech evaluation apparatus 20*b* carries out the processing flow of a step S34 and the subsequent steps. On the other hand, if the calculated degree of concavity and convexity is lower than the threshold set in advance (step S33: NO), the speech evaluation apparatus 20*b* makes transition to processing of a step S39.

The speech evaluation apparatus 20*b* sets a provisional change amount for searching for the change amount (step S34). The speech evaluation apparatus 20*b* carries out a spectrum transform of the input spectrum before change based on the set provisional change amount to calculate a processed spectrum (step S35). The speech evaluation apparatus 20*b* calculates the correlation between an input spectrum based on an input signal after change and the processed spectrum (step S36). The speech evaluation apparatus 20*b* updates the set provisional change amount (step S37). If the updated provisional change amount exists in a search range set in advance (step S38: YES), the speech evaluation apparatus 20*b* repeats the processing of the step S34 and the subsequent steps. On the other hand, if the updated provisional change amount does not exist in the search range (step S38: NO), the speech evaluation apparatus 20*b* makes transition to determination of whether or not the next frame exists (step S39). If the calculation of the degree of concavity and convexity has not ended regarding all frames of the input voice (step S39: NO), the speech evaluation apparatus 20*b* executes the frequency transform processing such as an FFT in the step S31. On the other hand, if the calculation of the degree of concavity and convexity has ended regarding all frames (step S39: YES), the speech evaluation apparatus 20*b* ends the processing of the determination of whether or not the next frame exists.

The speech evaluation apparatus 20*b* carries out the speech impression evaluation based on a statistic of the change amount of plural clock times (step S40). In the present embodiment, the speech evaluation apparatus 20*b* carries out the speech impression evaluation based on the average of the change amounts in plural frames as represented in (Expression 11) and (Expression 12). By obtaining the average of the change amounts in plural frames, the speech evaluation apparatus 20*b* may statistically evaluate the speech impression in a certain time.

As described above, if the degree of concavity and convexity is equal to or higher than a certain value, the speech evaluation apparatus 20*b* calculates the correlation value between the input spectrum and the processed spectrum with update of the provisional change amount and thereby may accurately calculate the change amount.

Figure 7:
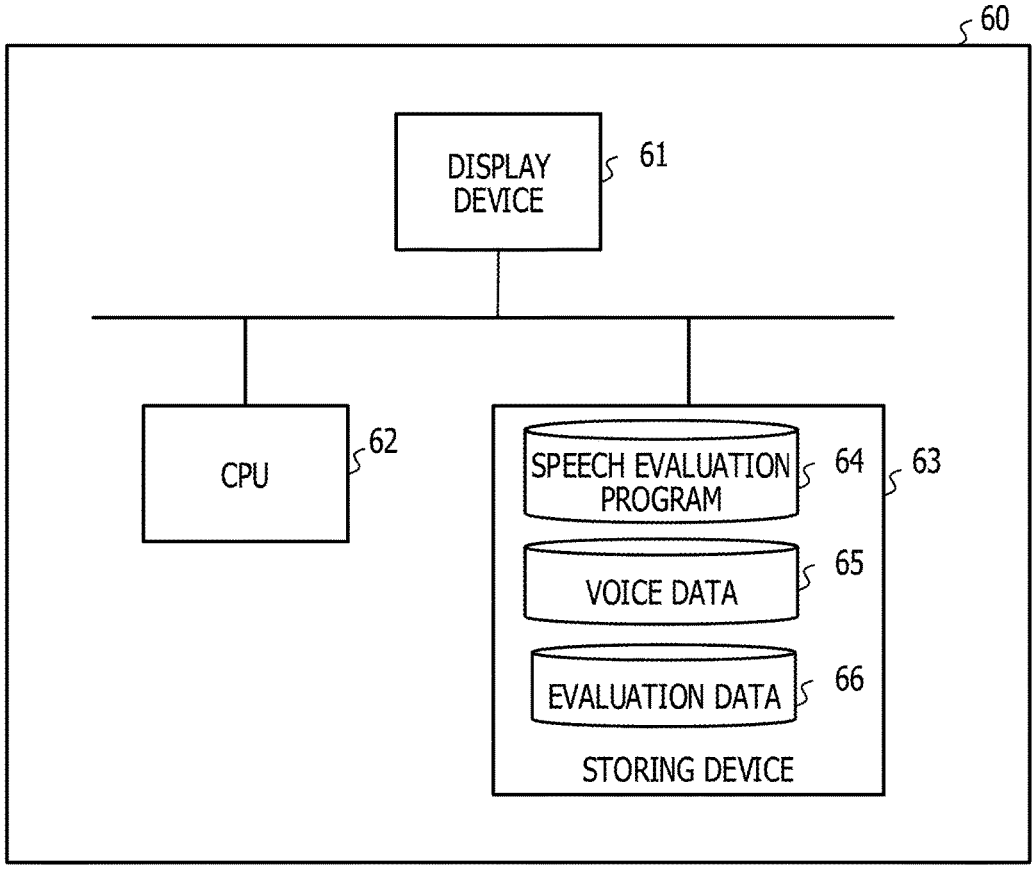
FIG. 7 is a hardware block diagram of a computer for executing speech evaluation processing.

FIG. 7 is a hardware block diagram of a computer for executing speech evaluation processing. In FIG. 7, a computer 60 includes a display device 61, a CPU 62, and a storing device 63.

The display device 61 is, for example, a display and displays a speech evaluation result. The CPU 62 is an arithmetic processing device for executing a program stored in the storing device 63. The storing device 63 is a device for storing data, programs, and so forth, such as a hard disk drive (HDD), a read only memory (ROM), and a random access memory (RAM).

The storing device 63 includes a speech evaluation program 64, voice data 65, and evaluation data 66. The speech evaluation program 64 is a program for causing the CPU 62 to execute speech evaluation processing. The CPU 62 implements the speech evaluation processing by reading out the speech evaluation program 64 from the storing device 63 and executing the speech evaluation program 64. The voice data 65 is voice data of the target of the speech evaluation processing. The evaluation data 66 is data obtained by recording an evaluation result of the speech evaluation processing of the voice data 65.

The CPU 62 functions as speech evaluation apparatus by reading out the speech evaluation program 64 from the storing device 63 and executing the speech evaluation program 64. The CPU 62 reads out the voice data 65 from the storing device 63 and executes the speech evaluation processing. The CPU 62 writes the result of the speech evaluation processing executed for the voice data 65 to the storing device 63 as the evaluation data 66. The CPU 62 reads out the evaluation data 66 written to the storing device 63 and causes the display device 61 to display the evaluation data 66.

As described above, the computer 60 may function as the speech evaluation apparatus by executing the speech evaluation program 64 by the CPU 62. Furthermore, by implementing the speech evaluation apparatus 20*b* in FIG. 6 as the speech evaluation apparatus, the voice data 65 recorded in the storing device 63 as illustrated in FIG. 7 may be comprehensively evaluated.

Figure 8:
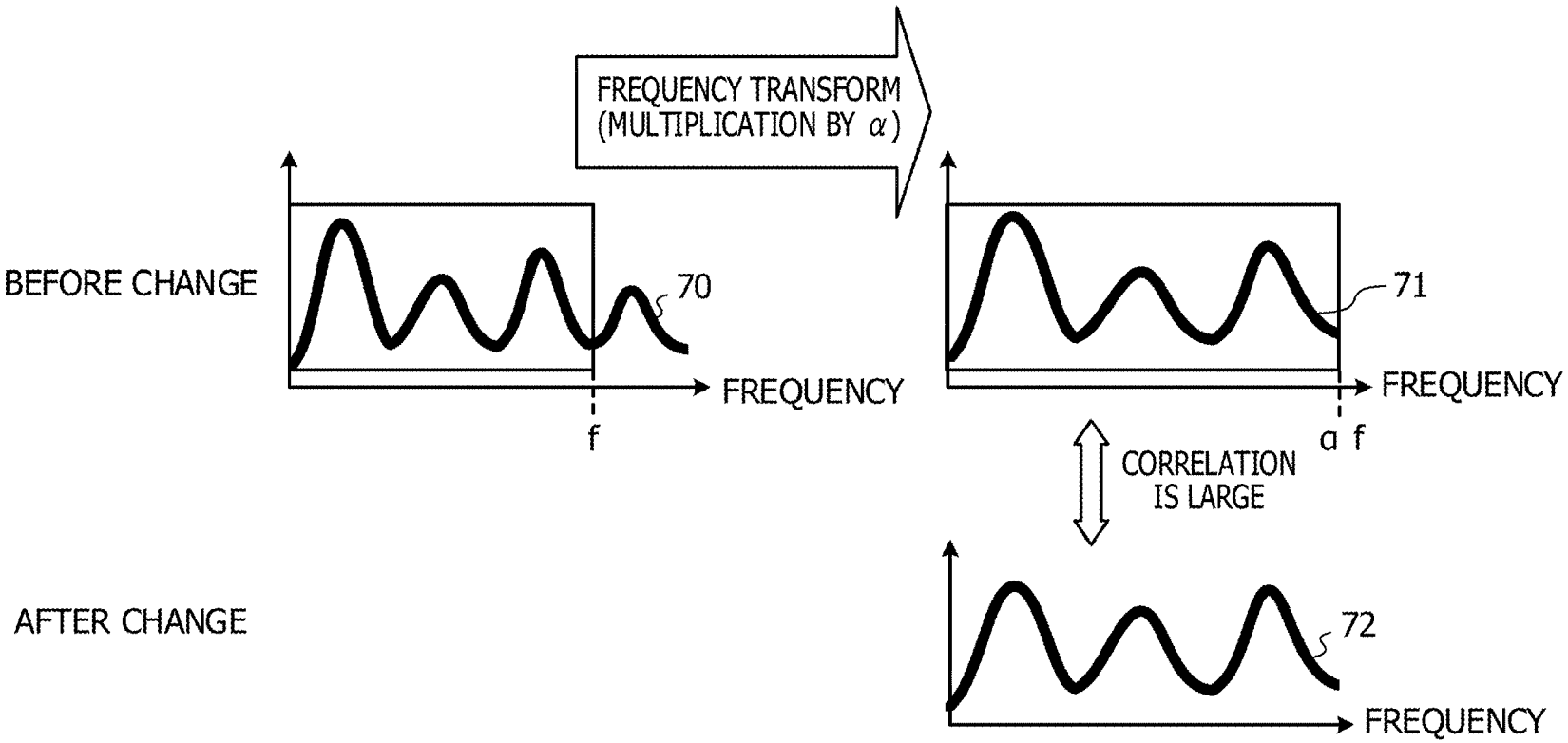
FIG. 8 is a diagram for visually explaining speech evaluation processing.

FIG. 8 is a diagram for visually explaining speech evaluation processing. In FIG. 8, an input spectrum 70 is a frequency spectrum obtained by a frequency transform of a voice before change in the pitch regarding an input voice as the evaluation target. The speech evaluation apparatus multiplies the frequency of the input spectrum 70 by $\alpha$ based on a provisional change amount to generate a processed spectrum 71.

An input spectrum 72 is a frequency spectrum obtained by a frequency transform of a voice after change in the pitch regarding the input voice as the evaluation target. The speech evaluation apparatus calculates the correlation value between the processed spectrum 71 and the input spectrum 72 while changing the value of the provisional change amount $\alpha$ and stores the provisional change amount in the case in which the correlation value is largest as the change amount of the input voice as the evaluation target.

As described above, the speech evaluation apparatus may accurately calculate the change amount by calculating the correlation value between the input spectrum and the processed spectrum with update of the provisional change amount.

A computer program that causes a computer to execute the above-described speech evaluation processing and a non-transitory computer-readable recording medium in which the program is recorded are included in the scope of the disclosed techniques. Here, the non-transitory computer-readable recording medium is a memory card such as a secure digital (SD) memory card. It is to be noted that the above-described computer program is not limited to a computer program recorded in the above-described recording medium and may be a computer program transmitted via an electrical communication line, a wireless or wired communication line, a network typified by the Internet, or the like.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A speech evaluation apparatus comprising:

a memory; and a processor coupled to the memory and configured to:

calculate an autocorrelation value of a first signal that is a signal of a first period;

determine whether the calculated autocorrelation value is no less than a threshold;

generate, when the calculated autocorrelation value is no less than a threshold, a first input spectrum obtained by frequency transforming the first signal;

generate a second input spectrum obtained by frequency transforming a second signal that is the signal of a second period earlier than the first period;

generate a processed spectrum obtained by transforming the second input spectrum in accordance with a coefficient;

calculate a correlation value between the first input spectrum and the processed spectrum; and determine a change amount of pitch frequency between the first signal and the second signal in accordance with the coefficient and the correlation value.

2. The speech evaluation apparatus according to claim 1, wherein the processor is configured to generate a plurality of processed spectra by transforming the second input spectrum in accordance with a plurality of coefficient, and calculate each of correlation values between the first input spectrum and the plurality of processed spectra, and wherein the correlation value is larger than each of the correlation values.

3. The speech evaluation apparatus according to claim 1, wherein the coefficient is a value in a range of 0.5 to 2.

4. The speech evaluation apparatus according to claim 1, wherein the transforming of the first signal includes generating a first residual signal by linear prediction analysis of the first signal, and performing frequency analysis of the first residual signal, and the transforming of the second signal includes generating a second residual signal by linear prediction analysis of the second signal, and performing frequency analysis of the second residual signal.

5. The speech evaluation apparatus according to claim 1, wherein the processor is configured to output evaluation of the signal based on the determined change amount.

6. The speech evaluation apparatus according to claim 5, wherein the evaluation of the signal is based on a statistic of a plurality of change amounts including the change amount.

7. A computer-implemented speech evaluation method comprising:

calculate an autocorrelation value of a first signal that is a signal of a first period;

determine whether the calculated autocorrelation value is no less than a threshold;

generating, when the calculated autocorrelation value is no less than a threshold, a first input spectrum obtained by frequency transforming the first signal;

generating a second input spectrum obtained by frequency transforming a second signal that is the signal of a second period earlier than the first period;

generating a processed spectrum obtained by transforming the second input spectrum in accordance with a coefficient;

calculating a correlation value between the first input spectrum and the processed spectrum; and determining a change amount of pitch frequency between the first signal and the second signal in accordance with the coefficient and the correlation value.

* * * * *